US005575434A

United States Patent [19]

Steinmair

[11] Patent Number: 5,575,434

[45] Date of Patent: Nov. 19, 1996

[54] STRIP ACCUMULATOR

[75] Inventor: Karl Steinmair, Schiedlberg, Austria

[73] Assignee: Voest-Alpine Industrieanlagenbau GmbH, Linz, Austria

[21] Appl. No.: 433,419

[22] PCT Filed: Aug. 12, 1994

[86] PCT No.: PCT/AT94/00113

§ 371 Date: Jun. 1, 1995

§ 102(e) Date: Jun. 1, 1995

[87] PCT Pub. No.: WO95/06528

PCT Pub. Date: Mar. 9, 1995

[30] Foreign Application Priority Data

Sep. 1, 1993 [AT] Austria ..... A 1752/93

[51] Int. Cl.[6] ..... B65H 20/26

[52] U.S. Cl. ..... 242/364.1

[58] Field of Search ..... 242/364.1, 364, 242/364.2, 364.3

[56] References Cited

U.S. PATENT DOCUMENTS

| | | | |
|---|---|---|---|
| 3,341,139 | 9/1967 | La Tour . | |
| 3,782,662 | 1/1974 | Miller . | |
| 3,860,188 | 1/1975 | Bradshaw | 242/364.1 |
| 4,441,661 | 4/1984 | Steinmair | 242/364.1 |
| 4,473,193 | 9/1984 | Cooper et al. | 242/364.1 |
| 4,569,487 | 2/1986 | Sluzallek | 242/364 |

FOREIGN PATENT DOCUMENTS

| | | | |
|---|---|---|---|
| 333691 | 4/1976 | Austria . | |
| 3321786 | 3/1987 | Germany . | |
| 50-97557 | 8/1975 | Japan | 242/364.1 |
| 57-017326 | 1/1982 | Japan . | |
| 59-203045 | 11/1984 | Japan | 242/364.1 |
| 62-089527 | 4/1987 | Japan . | |
| 1340855 | 9/1987 | U.S.S.R. | 242/364.1 |

*Primary Examiner*—John M. Jillions
*Attorney, Agent, or Firm*—Collard & Roe, P.C.

[57] ABSTRACT

A strip accumulator comprises an outer circular set of radially extending carrying rollers which serve to carry an upright outer strip coil, a concentric inner circular set of radially extending, freely rotatable carrying rollers for an inner strip coil connected to the outer strip coil by a reversing loop, a core for the inner strip coil comprised of a roller cage consisting of rollers having parallel axes, one of which is a payout roller for guiding the strip to an inclined delivery roller within the cage. To make the accumulator independent of the dimensions and material properties of the strip, a looping roller for forming the reversing loop is provided between the sets of carrying rollers. The looping roller revolved about the axis of the circular sets at a velocity that is equal to one-half of the difference between the velocities of the incoming and outgoing strips, and a circular set of inclined rollers extend radially inwardly on the inside of the outer circular set of carrying rollers. The inclined rollers are inwardly upwardly inclined and/or are inclined relative to a radial orientation in a sense opposite to the sense of rotation of the outer strip coil.

4 Claims, 3 Drawing Sheets

STRIP ACCUMULATOR

Figure 1:
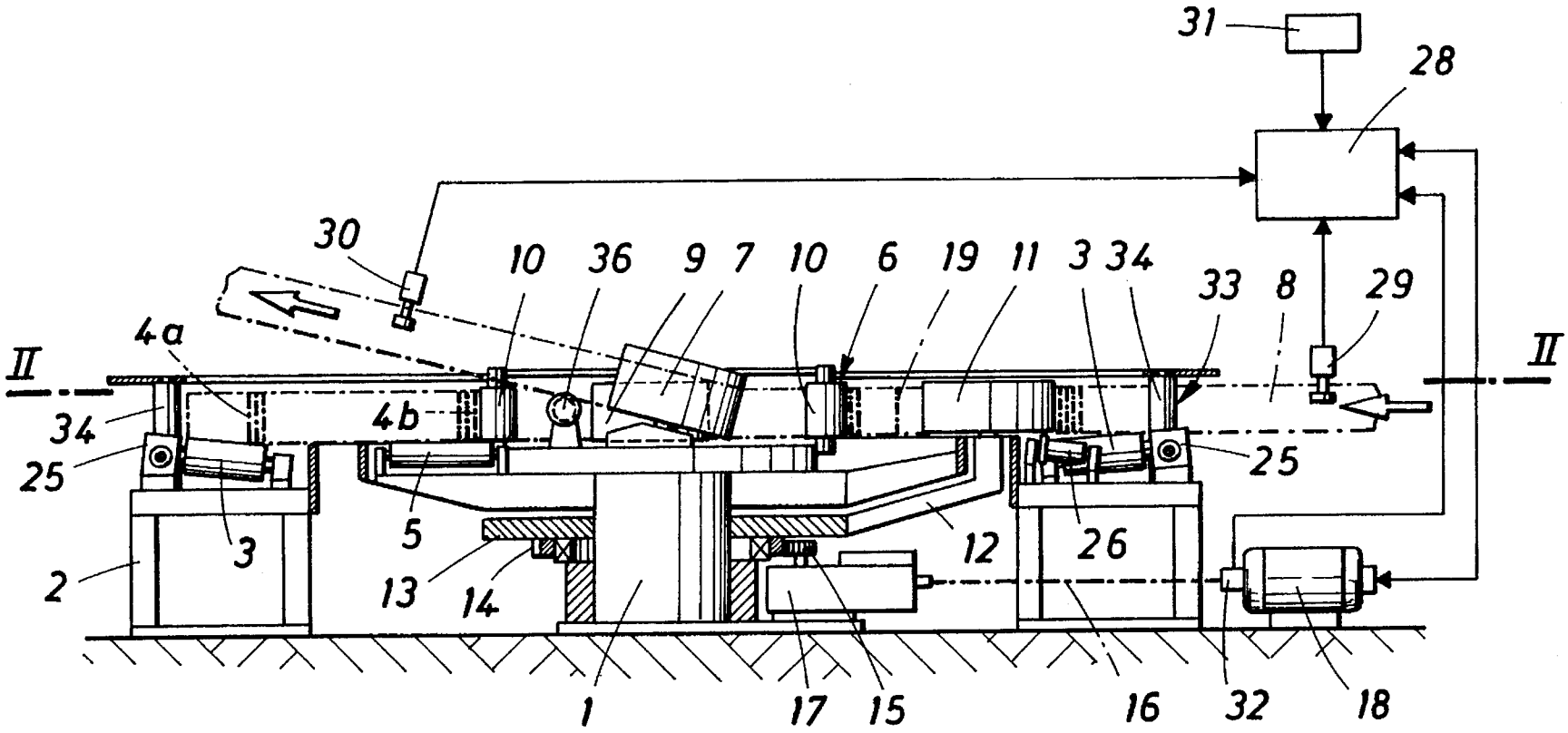

This invention relates to a strip accumulator comprising an outer circular set of carrying rollers, which extend radially with respect to a vertical axis of the set and serve to carry an upright outer strip coil, which receives strip on the outside from a strip feeder, a concentric inner circular set of freely rotatably mounted, radially extending inner carrying rollers for carrying an inner strip coil, which is connected to the outer strip coil by a reversing loop, and a roller cage, which constitutes a core for the inner strip coil and comprises axially parallel rollers, one of which serves as a payout roller for guiding the strip to an inclined delivery roller disposed within the roller cage.

In a known apparatus of that kind (U.S. Pat. No. 3,782,662) the metal strip which enters the strip accumulator is wound from the outside of an upright outer strip coil, which rests on a rotatable annular deck or on an outer circular set of drivable, preferably tapered carrying rollers. Because that outer strip coil does not require a roller cage as a core, the inside diameter of the outer strip coil is defined only by the relationship between the velocity of the incoming strip and the speed of the deck. From that outer strip coil the strip moves through a reversing loop to an inner strip coil, which is carried by an inner circular set of freely rotatably mounted carrying rollers, which are disposed within the rotatable annular deck, and said inner strip coil is backed by a core consisting of a roller cage, which surrounds an inclined delivery roller. From the inside of the inner strip coil the strip is delivered opposite to the direction of rotation of the incoming strip by a pay-out roller of the cage to the delivery roller, by which the strip is delivered from the accumulator. Because the two concentric strip coils are connected by a reversing loop, which revolves at a velocity that is one-half of the difference between the velocities of the incoming and outgoing strips, the incoming strip will be wound up on the two strip coils in equal numbers of turns. As the strip is delivered from the accumulator, equal numbers of turns are unwound from the two strip coils so that the capacity of the accumulator can desirably be utilized regardless of the actual velocities at which the strip is being received and delivered, respectively. A disadvantage resides in that the size of the reversing loop will depend on the thickness of the strip and particularly in the case of relatively thick strip will require large radii of curvature at the bend so that the rotary deck must have a correspondingly large outside diameter. A disadvantage involved in the handling of relatively thin strip resides in that the strip may buckles under the pressure forces exerted on the strip on that side of the reversing loop which faces the outer strip coil. Besides, the position of the outer coil strip on the rotary deck will not be stabilized because it depends on various influences.

In a vertical-axis strip accumulator comprising two concentric roller cages for respectively supporting outer and inner strip coils, it is desirable to permit the strip to be moved in the empty accumulator from the strip feeder to an inclined delivery roller disposed within the inner roller cage without a formation of a turn. To that end it is known (Published German Application 33 21 786) to use one of the rollers of the rotatably mounted outer roller cage as a looping roller. As a result, in the empty accumulator the strip can move through the outer roller cage between that looping roller and the adjacent roller of the outer cage and may then move between two rollers of the inner roller cage to the delivery roller without forming a turn. When it is desired to accumulate strip, the outer roller cage is rotated and the looping roller causes the strip to form a reversing loop, from which the strip is wound up on the two roller cages in the same numbers of turns. That known strip accumulator has mainly the disadvantage that the rollers of the roller cages must be radially displaced in the dependence on the changes of the diameters of the strip coils and this requirement considerably adds to the structural expenditure.

For this reason it is an object of the invention so to improve by the use of simple means a strip accumulator which is of the kind described first hereinbefore that the accumulator can be used with good results to accumulate thin and thick metal strip, that its outside diameter may be relatively small regardless of the thickness of the strip to be handled, and that the position of the outer strip coil will be stabilized.

The object set forth is accomplished in accordance with the invention in that a looping roller for forming the reversing loop is provided between the outer and inner circular sets of carrying rollers and is adapted to be driven to revolve about the axis of said circular sets at a velocity that is equal to one-half of the difference between the velocities of the incoming and outgoing strips and that the accumulator comprises on the inside of the outer circular set of carrying rollers a circular set of inclined rollers, which either increase radially inwardly in diameter and/or relative to a radial orientation with respect to the axis of the circular set are inclined in a sense which is opposite to the sense of rotation of the outer strip coil.

Because a looping roller is provided, which is drive to revolve about the axis of the two circular sets of carrying rollers at a velocity which is one-half of the difference between the velocities of the incoming and outgoing strips in the strip accumulator, the radius of curvature at the bend of the reversing loop of the strip will be determined by the radius of the looping roller rather than by the bending behavior which would be exhibited by the unrestrained strip in dependence on its thickness and material. If the looping roller is designed for the smallest permissible diameter of that of the strips which can be handled by the accumulator and requires the reversing loop to have the largest radius of curvature at its bend, all strips will form the same reversing loops and the outside diameter of the strip accumulator may be rather small even for the handling of thick strips. The tensile forces exerted on the strip by the looping roller adjacent to the reversing loop ensure that the strip will contact the peripheral surface of the looping roller and will permit an accumulation also of thin strip because it can no longer buckle under the action of pressure forces which otherwise would be exerted adjacent to the bend of the reversing loop.

To permit a full utilization of the advantages which are afforded by the fact that the strip is reversed by a looping roller that revolves between the two strip coils, a stable position of the outer strip coil must be ensured because that outer coil is not backed by a roller cage or the like. To that end a circular set of inclined rollers are provided, which owing to their inclined position urge in a radially outward direction those inner turns of the outer strip coil which are urged against the inclined rollers. This action will result in a stable equilibrium. The inclined rollers may be inclined about an axis which is tangential to the peripheral direction of the strip coil and about a vertical axis. It is essential that the position of the inner turns of the outer coil strip can be defined by the additional constraint which is effected by the inclined rollers so that the looping roller disposed between the two strip coils will operate under disposed conditions. Besides, each inclined roller may be provided at its inner end with a stop collar, which will constrain the innermost turn of the outer strip coil but will not interfere with the unwinding of the currently innermost turn of the strip. The stability of the position of the outer strip coil will additionally be assisted if the carrying rollers of the outer set are inwardly and downwardly inclined.

The drive means for moving the looping roller between the two strip coils must be controlled in dependence on the velocities of the incoming and outgoing strips in the strip accumulator. It is also desired to influence the tensile forces which are exerted on the strip adjacent to the reversing loop by the looping roller and to ensure that the strip will contact the peripheral surface of the looping roller. To this end, a control of the torque which is exerted in dependence on the thickness and width of the strip to be accumulated may be superposed on the control of the velocity imparted to the looping roller by the associated drive means. By that superposed control the conditions under which the strip is reversed in the reversing loop between the two strip coils can desirably be adapted to a given strip to be accumulated.

Figure 2:
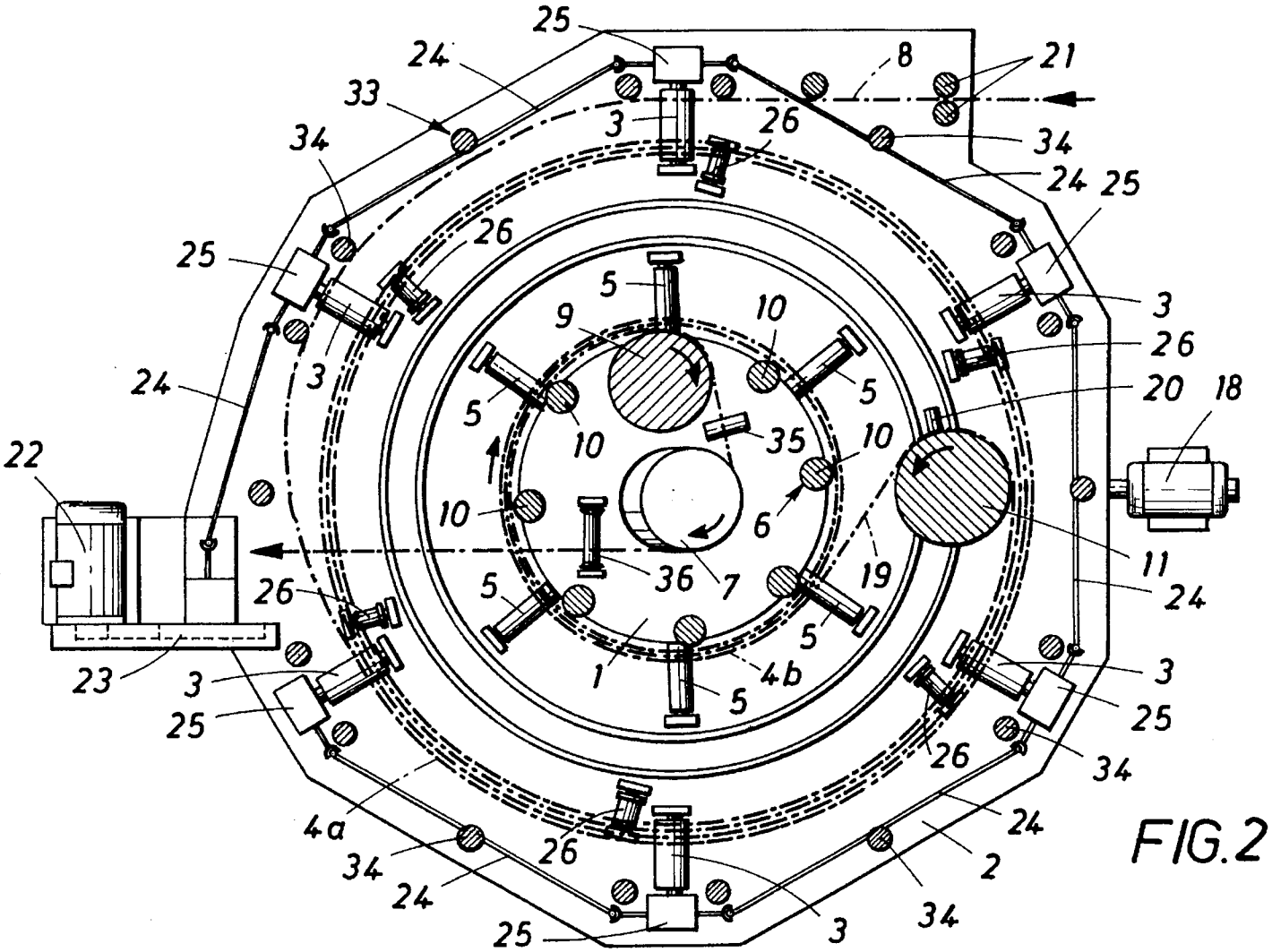
Figure 3:
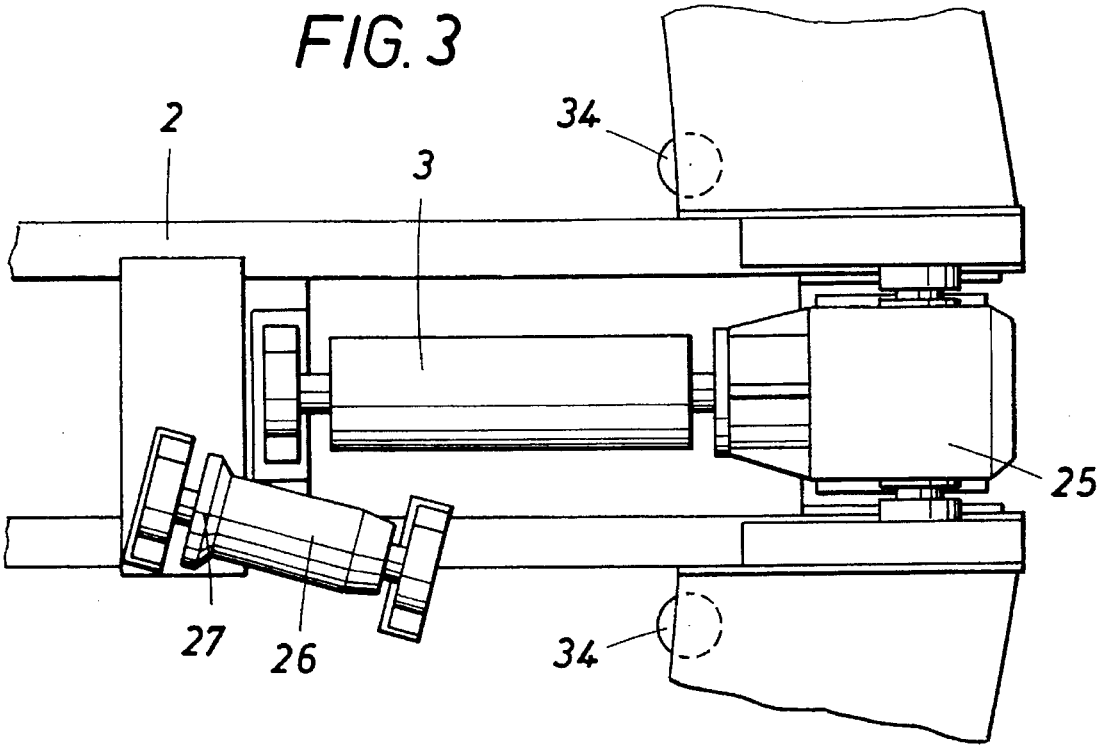
Figure 4:
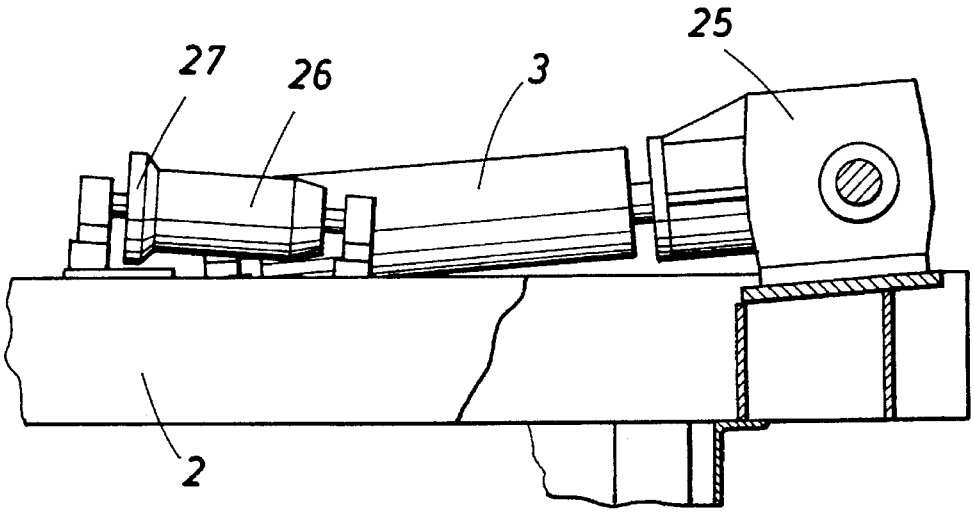

The subject matter of the invention is shown by way of example in the drawing, in which FIG. 1 is a schematic axial sectional view showing a strip accumulator in accordance with the invention, FIG. 2 is a sectional view showing that strip accumulator and taken on line II—II in FIG. 1, which line is normal to the axis of the accumulator, FIG. 3 is a top plan view showing on a larger scale a portion of the strip accumulator adjacent to a carrying roller, which is included in the outer circular set and cooperates with an inclined roller, and FIG. 4 is a side elevation showing the inclined roller and the carrying roller of FIG. 3.

In the embodiment illustrated by way of example the strip accumulator comprises an annular frame 2, which surrounds a table 1 and carries an outer circular set of driven carrying rollers 3, which extend radially with respect to the axis of the circular set and serve to carry an upright outer strip coil *4a*. The table 1 carries a concentric inner circular set of also radially extending carrying rollers 5, which are freely rotatably mounted and extend radially outwardly from a roller cage 6, as is particularly apparent from FIG. 2. An inclined delivery roller 7 is provided within the roller cage 6 and receives the strip 8 from a payout roller 9, which consists of one of the rollers 10 of the roller cage 6.

A looping roller 11 is provided between the two circular sets of carrying rollers 3 and 5 and is freely rotatably mounted on an arm 12, which generally radially outwardly protrudes from and is rigid with a turntable 13 and in unison with the turntable 13 can be rotated about the axis of the table 1. To that end the turntable 13 is mounted to be rotatable about the axis of the table 1 and is provided with a ring gear 14, which meshes with a pinion 15. The pinion 15 is driven by a motor 18 via a universal joint shaft 16 and a transmission 17 so that the looping roller 11 can be used to form the strip 8 into a reversing loop 19 between the outer strip coil *4a* and an upright inner strip coil *4b*, which is supported by the carrying rollers 5 of the inner circular set and is constituted by strip being wound up on the roller cage 6. The reversing loop 19 is supported by a backing roller 20, which is rotatably mounted on the arm 12 which carries the looping roller 11.

The strip 8 is received by the strip accumulator through a strip feeder 21 that consists of two rollers and delivers the strip onto the carrying rollers 3 of the outer circular set. As is apparent from FIG. 2 said carrying rollers 3 are driven by a motor 22 via a suitable transmission 23, universal joint shafts 24, and angle drives 25. The strip received by the strip accumulator is conveyed by the driven carrying rollers 3 of the outer circular set and is wound up to form a strip coil *4a* supported by the carrying rollers 3. The position of that strip coil *4a* is structurally defined by means of a circular set of inclined rollers 26, which are disposed on the inside of the circular set of carrying rollers 3 and in the illustrative embodiment are upwardly inclined toward the axis of the circular set (FIG. 4) and with respect to a radial orientation relative to the axis of the circular set are inclined opposite to the sense of the revolving movement of the strip 8 in the outer strip coil *4a* (FIG. 3). As inner turns of the strip coil *4a* are urged against said inclined rollers, said inner turns are urged radially outwardly by said inclined rollers so that an equilibrium is established between the inner turns, which are urged radially outwardly, and the outer turns, which are urged radially inwardly, and the position of the strip coil *4a* is thus stabilized. The innermost turn of the strip coil *4a* may be constrained by a stop collar 27 on the inner end of each inclined roller. The action by which the outer turns are urged radially inwardly can be assisted in that the carrying rollers 3 of the outer circular set are inwardly and downwardly inclined.

From the innermost turn of the outer strip coil *4a* the strip moves in a reversing loop 19 to the inner strip coil *4b*, which is being wound up on the outside of the roller cage 6. From the innermost turn of the inner strip coil *4b* the strip 8 moves around the payout roller 9 and inwardly to the inclined delivery roller 7, by which the strip is delivered from the strip accumulator. When strip 8 is only to be accumulated in the strip accumulator whereas no strip is to be delivered by the accumulator, the looping roller will revolve at a velocity which is one-half of the velocity of the incoming strip and the strip will be wound in equal numbers of turns on the inner and outer strip coils *4b* and *4a*. When strip is being delivered but no strip is being received, the looping roller 11 will revolve in a sense which is opposite to the winding sense and its velocity will be one-half of the velocity of the outgoing strip and the strip will be unwound in equal numbers of turns from the outer and inner strip coils. If strip is being received and delivered at the same velocity, the drive from the looping roller 11 will hold the latter at a standstill. For this reason the looping roller 11 must always revolve at a velocity which is one-half of the difference between the velocities of the incoming and outgoing strips in the accumulator. This is ensured by a controller 28, which is connected to a velocity sensor 29 for measuring the velocity of the strip 8 which is being received by the strip accumulator and to a velocity sensor 30 for measuring the velocity of the strip that is being delivered from the strip accumulator. This is apparent from the block circuit diagram shown in FIG. 1. The motor 18 for driving the looping roller 11 is controlled in dependence on the difference between the velocities of the incoming and outgoing strips and desirably causes the strip 8 to form the reversing loop 19. The formation of that reversing loop is substantially independent of the size and properties of a given strip being handled. In the handling of relatively thick strip 8 it is desired to exert a higher tensile stress by the looping roller 11 on the strip in order to ensure a surface contact between the reversing loop 19 and the peripheral surface of the looping roller 11. This can be accomplished in that the controller 28 controls also the torque which is exerted by the motor. The thickness of the strip is entered into the controller 28 via input means 31. In accordance with a predetermined relationship between the required torque and the thickness of the strip the controller determines a torque setpoint, which is compared with the actual torque, which is measured by a torque sensor 32, so that a correction can be effected in response to an occurrence of a difference between the setpoint and the actual value. The input means 31 may be used to permit a control of the torque of the motor 18 and, as a result, of the effective tensile stresses in the reversing loop 19, in dependence on additional variables, such as the width of material properties of the strip that is to be accumulated.

The outside diameter of the outer strip coil 4*a* which is being formed may be limited by an outer roller cage 33, which comprises rollers 34. But such a roller cage 33 is not essentially required for the actual accumulation of strip in two strip coils 4*a* and 4*b*, which rotate in mutually opposite senses and are connected by a reversing loop 19. Moreover, the backing rollers 35 and 36 for engaging the strip between the payout roller 9 and the delivery roller 7 and for engaging the outgoing strip downstream of the delivery roller may be omitted under certain circumstances.

What is claimed is:

1. A strip accumulator comprising an outer circular set of carrying rollers, which extend radially with respect to a vertical axis of the set and serve to carry an upright outer strip coil receiving a strip from a strip feeder positioned outside the outer circular set, a concentric inner circular set of freely rotatably mounted, radially extending inner carrying rollers for carrying an inner strip coil connected to the outer strip coil by a reversing loop, a roller cage, which constitutes a core for the inner strip coil and comprises rollers having parallel axes, one of the rollers serving as a payout roller for guiding the strip to an inclined delivery roller disposed within the roller cage, a looping roller for forming the reversing loop arranged between the outer and inner circular sets of carrying rollers drivable to revolve about the vertical axis at a velocity that is equal to one-half of the difference between the velocities of the incoming and outgoing strips, and a circular set of radially inwardly extending inclined rollers inside of the outer circular set of carrying rollers, the inclined rollers being upwardly inclined towards the vertical axis and/or being inclined relative to a radial orientation with respect to the vertical axis in a sense which is opposite to the sense of rotation of the outer strip coil.

2. A strip accumulator according to claim 1, wherein each of the inclined rollers is provided with a stop collar at its inner end.

3. A strip accumulator according to claim 1, wherein the carrying rollers of the outer circular set are inwardly and downwardly inclined.

4. A strip accumulator according to claim 1, further comprising a control of the rotary velocity imparted to the looping roller, and a control of the torque of the looping roller responsive to the thickness and width of the strip.

* * * * *